US005104786A

United States Patent [19]

Chronis et al.

[11] Patent Number: 5,104,786

[45] Date of Patent: Apr. 14, 1992

[54] PLUG-FLOW PROCESS FOR THE NUCLEATION OF SILVER HALIDE CRYSTALS

[75] Inventors: Jane H. Chronis, Rochester; Philip J. Zola, Webster; David L. Benzing, Fairport, all of N.Y.

[73] Assignee: Eastman Kodak Company, Rochester, N.Y.

[21] Appl. No.: 604,276

[22] Filed: Oct. 29, 1990

[51] Int. Cl.[5] ..... G03C 1/015

[52] U.S. Cl. ..... 430/569; 430/567

[58] Field of Search ..... 430/567, 569

[56] References Cited

U.S. PATENT DOCUMENTS

| | | | |
|---|---|---|---|
| 3,897,935 | 8/1975 | Forster et al. | 336/339 |
| 4,147,551 | 4/1979 | Finnicum et al. | 430/569 |
| 4,171,224 | 10/1979 | Verhille et al. | 430/569 |
| 4,722,886 | 2/1988 | Nottorf | 430/569 |
| 4,775,617 | 10/1988 | Goda | 430/567 |

FOREIGN PATENT DOCUMENTS

| | | |
|---|---|---|
| 0019847 | 12/1980 | European Pat. Off. . |
| 0362699 | 4/1990 | European Pat. Off. . |
| 3707135 | 9/1987 | Fed. Rep. of Germany . |

*Primary Examiner*—Charles L. Bowers, Jr.
*Assistant Examiner*—Janet C. Baxter
*Attorney, Agent, or Firm*—Paul A. Leipold

[57] ABSTRACT

The invention is generally accomplished by providing nucleation of silver halide crystals or grain without backmixing or exposure to previously nucleated grains. Generally this is accomplished by injecting a solution of silver nitrate into a solution of sodium bromide and peptizer as it is moving in pipe in a type of flow which does not provide back mixing and moves in generally plug flow. The plug flow is carried out until nucleation is complete and then the nucleated grains are transferred to a mixing container where they are ripened, grown, and subjected to the normal treatments, such as sensitization, applied to the silver halide to be used photgraphically.

13 Claims, 2 Drawing Sheets

PLUG-FLOW PROCESS FOR THE NUCLEATION OF SILVER HALIDE CRYSTALS

TECHNICAL FIELD

This invention relates to preparation of photosensitive silver halide.

BACKGROUND ART

It is well known that the properties of silver halide dispersions (so-called emulsions) are strongly influenced by the environmental conditions in which the silver halide grains are formed. The influential parameters are numerous. They include the mixing rates of solutions of reactive silver and halide salts, the relative amounts of the reactants in the reaction mixture, the pAg, the pH and the temperature of such mixture, and the mechanical forces to which the mixture is subjected. In the art of silver halide emulsion preparation, numerous measures are known for influencing emulsion properties and, in particular, for improving the uniformity of the emulsion and the reproducibility of results under industrial manufacturing conditions.

The formation technique for silver halide emulsions wherein nucleation and growth all take place in a single container is commonly practiced. This technique has the disadvantage that the previously nucleated grains are recirculated past the mixer where additional silver salt and halide salt solutions are being added. This brings together previously nucleated grains into the same system as newly nucleating grains. The material in the container has a continuously changing content of the salt byproducts of the nucleating process, as well as a continuously changing competition for silver and halide with previously nucleated grains. Therefore, given these changing conditions. it is not surprising that the nucleated grains formed at different times are different.

It is known to prepare silver halide emulsions batchwise by introducing silver salt and halide salt solutions into a circulating volume of peptizer solution which is repeatedly recycled. Note U.S. Pat. No. 4,334,012—Mignot where recirculation and ultrafiltration is discussed. This procedure has the advantage over non-recirculating preparation systems that small amounts of peptizer can be used. The recycling of peptizer solution and the addition of reactants thereto can continue until a silver halide emulsion with a predetermined concentration of silver halide is attained.

U.S. Pat. No. 4,171,224—Verhille et al discloses a method of bringing together separate streams of silver nitrate and a halide salt in the reaction zone. Material is recirculated through the reaction zone and further subjected to a continuous flow mixing passageway that will provide backflow of material.

U.S. Pat. No. 4,775,617—Goda is directed to the production of monodisperse grains. However, the grain sizes are adjusted after nucleation and while the sizes of the final grains may be somewhat monodisperse the formation history of the grains are different and therefore their properties are not uniform. There is a need for the method of nucleation that would provide each silver halide crystal or grain with a uniform history. By this it is meant that each grain would have been subjected to the same concentration of halide ion and silver ion during formation. Further, the individual grains would each be surrounded by silver grains that were identical to the silver grains surrounding other of the final crystals. It is known that in nucleation a multitude of crystals are formed whereas during ripening and growth most crystals are dissolved and redeposited on the surviving crystals. The composition and size of the crystals which do not survive but are dissolved and deposited on surviving crystals also determine the history of the particles in a photosensitive emulsion.

In U.S. Pat. No. 4,879,208—Urabe, mixing in a separate mixer vessel to nucleate prior to transfer to a larger reactor vessel is disclosed as producing more uniform silver halide grains.

There is a need for a method of achieving uniform nucleation conditions such that all reacting elements have the same history of mixing and reaction with the nucleating stream. Further, there is a need for isolation of forming silver halide nuclei from already formed crystals so that formation of younger nuclei will not be influenced by the presence of older crystals.

DISCLOSURE OF THE INVENTION

An object of the invention is to overcome disadvantages of prior silver halide grain nucleation processes.

An object of the invention is to provide a nucleation method without backflow of nucleating material.

Another object is to provide nucleated silver halide particles of the same history during formation.

A further object is to provide improved silver halide photographic emulsions.

These and other objects generally are accomplished by providing nucleation of silver halide crystals or grain without backmixing or exposure to previously nucleated grains. Generally this is accomplished by injecting a solution of silver nitrate into a solution of sodium bromide and peptizer as it is moving in pipe in a type of flow which does not provide back mixing and moves in generally plug flow. The plug flow is carried out until nucleation is complete and then the nucleated grains are transferred to a mixing container where they are ripened, grown and subjected to the normal treatments for, such as sensitization, applied to the silver halide to be used photographically. The geometric standard deviation of the residence time distribution of the silver halide crystals during said nucleating is less than 1.30.

The providing of uniform nuclei results in improved performance control in all later silver halide grain treatment such as ripening, growth rates, and finishing.

MODES FOR CARRYING OUT THE INVENTION

Figure 1:
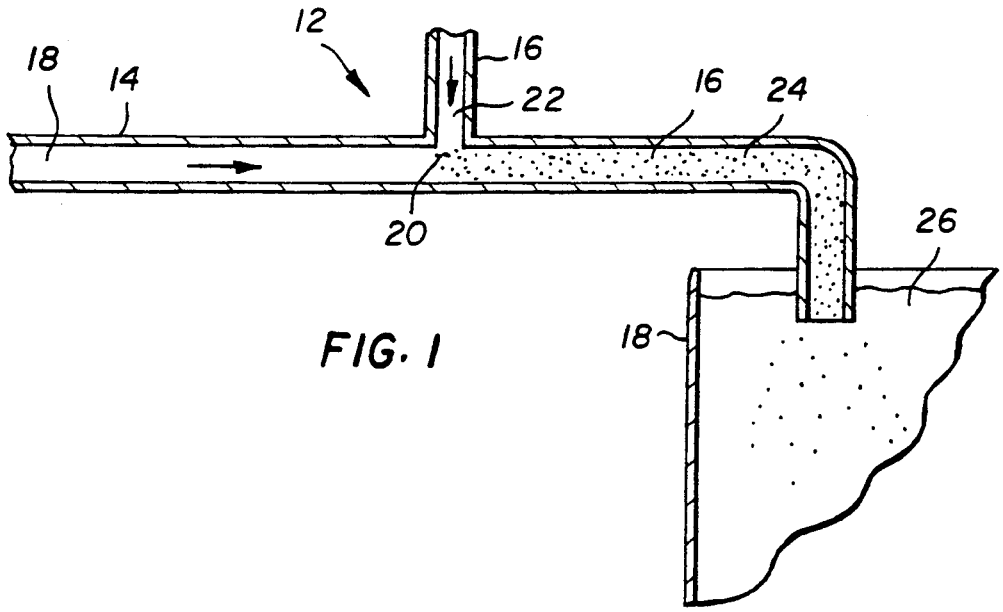
FIG. 1 illustrates in partial cross section the apparatus for carrying out the process.

The invention has numerous advantages over prior nucleation processes. The process is simple, not requiring any complicated mixing or transport mechanisms, as the nucleation preferably takes place in a pipe. Another advantage is that uniform nuclei are presented for ripening and growth resulting in uniform grains having predictable performance when processed for photographic use.

Another advantage is that by providing uniform crystals from the nucleation step, the control of the later ripening and growth processes is much easier as a nucleating product uniform in size and properties is presented at the beginning of these processes. These and other advantages of the invention will be apparent from the drawings and detailed description below.

Apparatus 12 comprises a pipe 14 that is provided with a T where pipe 16 joins pipe 14. The pipe is lead into a vat 18. A solution of water, gelatin, and sodium bromide is introduced into pipe 14 at 18 and moves to the T area 20 where nucleation is initiated as silver nitrate solution 22 enters main pipe 14. Flow in area 24 is controlled to prevent backmixing or laminar flow during passage through this section as the silver halide grains 26 are nucleated. The nucleated material passes into vat 18 for ripening and growth.

Figure 2:
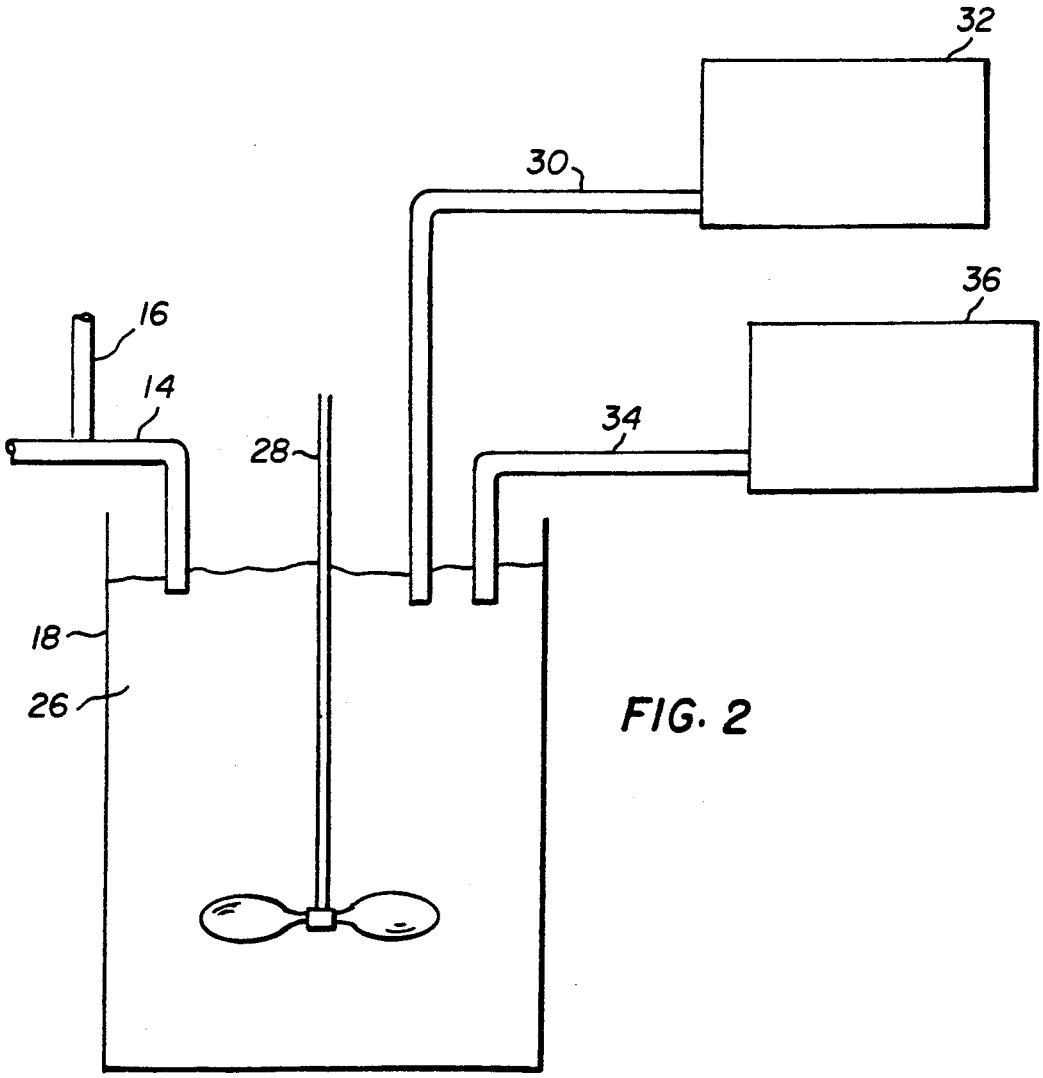
FIG. 2 illustrates schematic apparatus for performing the invention.

FIG. 2 illustrates schematically apparatus of the process in which pipe 14 is led into vat 18 where ripening and growth takes place in the dispersion 26. The dispersion is stirred by mixing means 28. Additional gelatin, and halide ions are provided through pipe 30 from source 32. Additional silver nitrate enters through pipe 34 from source 36.

Figure 3:
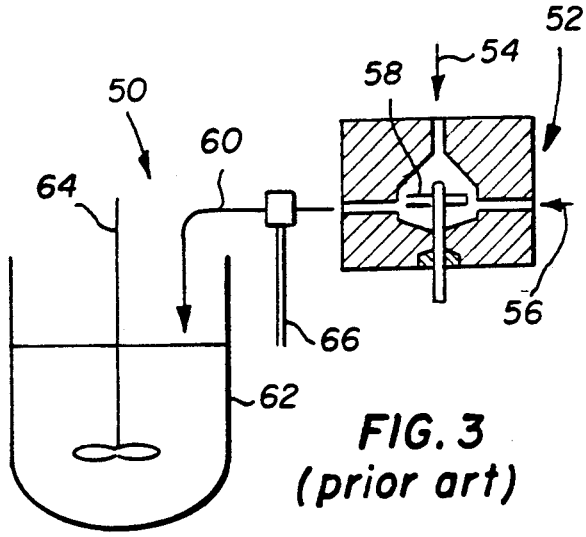
FIG. 3 (prior art)
FIG. 3 illustrates that prior method of mixing silver halide crystals with a separate nucleating device.

FIG. 3 illustrates a prior art method and apparatus, such as in U.S. Pat. No. 4,879,208—Urabe, of forming silver halide particles with some control of nucleation but with a system allowing backflow in the mixer where nucleation takes place. As illustrated therein apparatus 50 is provided with a separate mixing unit 52 to which silver nitrate is added through inlet 54 while gel and halide ions are added through inlet 56. The mixer 58 mixes these materials completely and then they are supplied by pipe 60 to the container 62 where ripening and growth is carried out under agitation by mixer 64. Pipe 66 serves to shunt waste material away from the mixer rather than into container 62.

Figure 4:
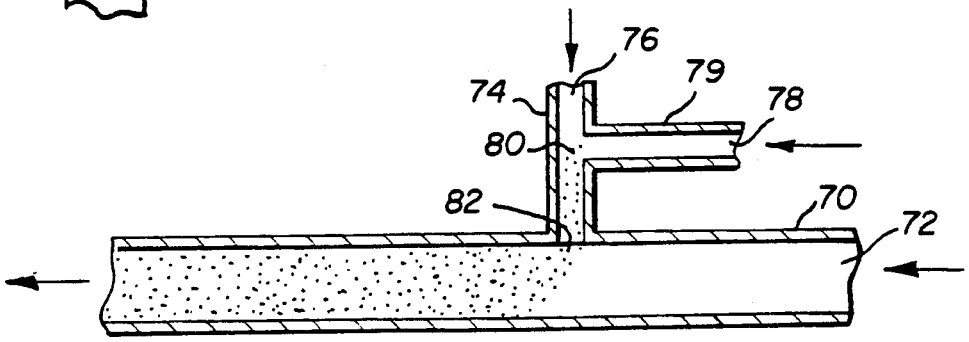
FIG. 4 illustrates a variation of apparatus suitable for the process of the invention.

FIG. 4 illustrates another possible embodiment of apparatus for the invention wherein largest diameter pipe 70 carries a gel solution 72.

While smaller diameter pipe 74 is supplied with a halide solution at 76. The halide solution meets a silver solution that is supplied at 78 from smallest diameter pipe 79 such that nucleation starts in area 80 and the initially nucleated material contacts the gel stream in pipe 70 at 82. The distance between 80 and 82 generally is very small, typically about 1.2 cm and the residence time would be about 3 mil sec prior to meeting the gel stream. The system is thought to provide more uniform initial mixing of the halide and silver ions together.

Figure 6:
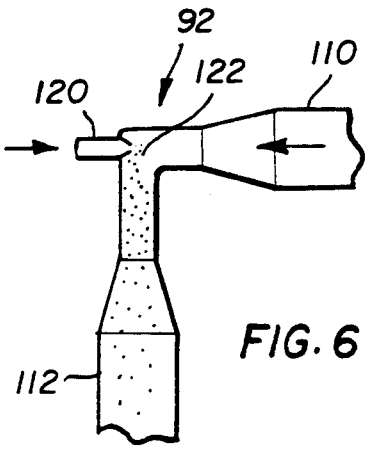
FIGS. 5 and 6 illustrate apparatus that may be utilized in practice of the invention.
Figure 5:
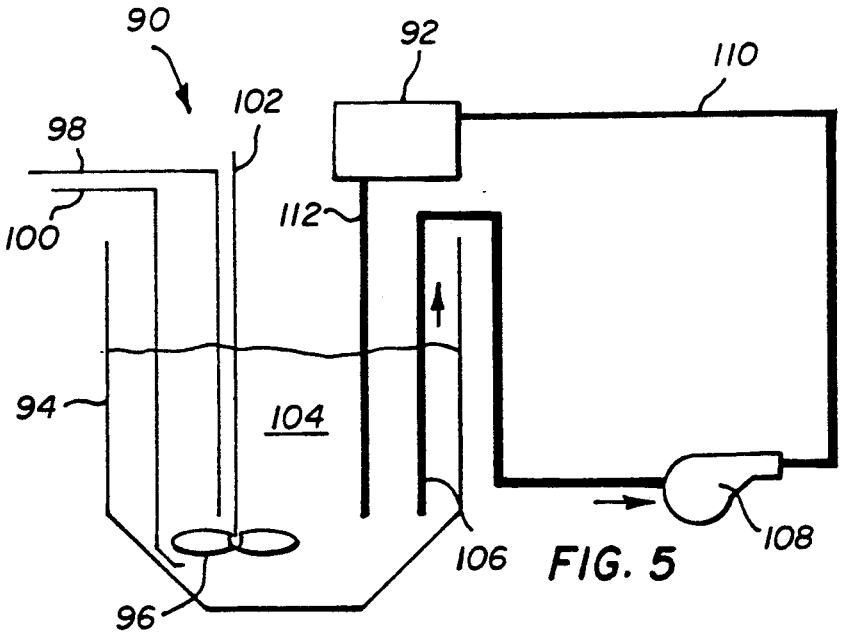

The apparatus of FIGS. 5 and 6 is similar to that utilized in prior processes with recirculation of the gelatin and silver halide during growth to provide a stream for addition of further reactive materials. In performing the process of the invention using apparatus 90, the container 94 is provided with a stirrer 96, inlet pipes 98 and 100 are utilized to add halide salts and silver nitrate during growth. The inlets 98 and 100 terminate immediately adjacent the mixer 96 that is rotated on a shaft 102. Nucleation is carried out by withdrawing peptizer liquid 104 from container 94 through the outlet pipe 106. The liquid is drawn into pipe 106 by pump 108 and carried through the outlet line from the pump line 110 to the opposed T 92 where silver nitrate is added and the nucleated liquid is returned via inlet pipe 112. As illustrated in the expanded view of the opposed T 92 in FIG. 6, the silver nitrate solution is added through inlet pipe 120 as the halide and peptizer solution enters through pipe 110 into the nucleating zone 122. In performing the invention, the nucleation is completed prior to the time that it takes for material to traverse pipes 106 and 110, such that no nucleated material is again exposed to the addition of silver nitrate from tube 120 at the opposed T 92. While recirculating apparatus such as this has been known in the art, it is not believed that there is any use of such apparatus disclosed wherein there is not continuous recirculation during nucleation including the recirculation of previously nucleated materials.

In general the tabular silver halide emulsion making process may be divided into several stages. In the first stage nucleation takes place and the initial silver halide grains are formed. Then these grains are ripened with control of temperature, acidity, and silver halide concentration in order to direct formation of a particular type of grain such as tabular or cubic grains. During ripening smaller grains and grains of the less preferred type will be dissolved and redeposited as the dominant grains grow in size and the less dominant grains are dissolved and disappear. After the ripening period additional silver and bromide are added in a controlled manner and the crystals are grown to a desired size for the particular photographic use. In the final stages of growth or after growth the crystals may be treated with various materials such as sensitizers to control their photographic properties. During growth and ripening dopants may be added that are incorporated in the crystals and change the photosensitive photographic properties of films formed from the grains. The invention is directed to the control of the nucleation step of the process and it is intended that the nucleated silver halide may be utilized for growth to any type of photographic silver halide grain.

The nucleating process of the invention may be carried out in any suitable manner. A preferred manner is in a pipe with a flow such that it has a Reynolds number of greater than 5,000. It is preferred that the Reynolds number be greater than 10,000 for most uniform nucleation. It is preferred that the residence time distribution of the nucleator be such that the residence time distribution be below 1.30 and preferably below 1.25 for best grain formation. If flow is not high enough laminar flow may take place in which case the middle portion of the material will move ahead of the edge portion whereas when turbulent plug flow is taking place the material on the cross-section of the pipe will move through the pipe at a substantially equal rate and not be mixed with material forward or behind it to a substantial extent. Plug flow is movement without circulation with other material forward or behind it in the direction of movement. However, circulation may take place with material perpendicular to the direction of movement and does not change the history of the grains.

Residence time distribution is a continuous system is the distribution function of the times required by all particles to travel from one particular point to another. In an ideal plug-flow system, all particles will take the same amount of time, and the residence time distribution will be a tall spike. In a back-mixed system, some particles will travel slowly, some quickly, and the residence time distribution will be a broad, soft peak. The geometric standard deviation of the residence times of all particles through the system is a measure of the width of that peak, and thus, is an indicator of the degree of plug-flow behavior of the system. Since a geometric standard deviation is dimensionless, it allows valid comparison between systems with different mixing patterns and mean residence times.

The following standard formulas were used to determine the residence time distribution of the invention process. The formula for geometric standard deviation is suitable where there is a large number of particles:

Geometric mean $= \bar{t}_g$ $$\bar{t}_g = \exp\left[\frac{\sum_1^n \ln t}{n}\right]$$

t = particle resident time
n = number of particles

Geometric standard deviation = SD $$SD = \exp\sqrt{\frac{\sum_1^n (\ln t)^2}{n} - (\ln \bar{t}g)^2}$$

t = particle number
n = number of particles

The time of nucleating in the method of the invention may be adjusted to produce desired grains. Generally the time is between 1 and about 30 seconds. A preferred time has been found to be about 15 seconds because good reproducibility is achieved, but nucleation time is short enough to prevent significantly different ages and consequently different ripening histories of grains in the kettle.

The process of the invention may be utilized for production of any type of silver halide particle including cubic, octahedral, or pebble-like. However, the process of the invention has been found to be particularly suitable for producing tabular grains. The production of tabular grain requires a twinning event in which the nucleated silver halide grain forms a face centered cubic crystal. The twinning event is an introduction of the twin plane into the crystal and is normally provided by a high salt concentration, low gelatin concentration and high mixing intensity during ripening. With proper control the probability for the twinning event to take place is higher. Initial nucleation will result in only a small fraction of tabular grains, but proper ripening will allow the tabular grains to rapidly grow and by Ostwald processes dissolve the other silver halide grains and deposit the silver halide on the twinned grains. The providing of a uniform nucleation event with grains being provided for ripening having substantially identical histories allows better control of the window to cause twinning to take place and Ostwald ripening to sacrifice non-twinned grains and deposit them on the twinned grains. The exposure to older grains in the nucleation time produces non-uniform grains and these grains are harder to ripen to form uniform tabular grains.

While the above description of the drawings sets forth that the larger diameter pipe was provided with the solution of gelatin peptizer and halide salt being present in larger pipe with the T for addition of silver nitrate it is possible that the larger pipe could contain the silver nitrate and gelatin while the smaller T added only a halide solution.

The halide salt suitable for the invention may be either a potassium bromide or sodium bromide when the process is utilized for forming tabular grains or mixed bromoiodide grains. If other types of grains are intended the salts could be sodium or potassium, chloride or iodide.

The peptizer may be any vehicle that will not adversely affect photograhic performance and will provide a vehicle for formation of silver halide and its casting into photographic products. The preferred material is natural alkali treated gelatin in aqueous solution as it provides the best medium for silver halide formation and photographic coating.

The nucleated silver halide formed by the invention may be further processed by any of the known techniques for photographic film formation. Such techniques and materials are disclosed in the *Research Disclosure* Issue 308, December, 1989, No. 308, 119 pp. 993–1015.

The following samples are intended to be illustrative but not limiting as to processes in accordance with the invention. Parts and percentages are by weight unless otherwise indicated.

EXAMPLE 1 (CONTROL)

a) Into an agitated vessel containing 18.3 liters solution of 4 g/liter gelatin and 0.068N NaBr at 35° C., was run 0.296N $AgNO_3$ solution in the close vicinity of the mixer at 0.067 liters/min. for 2 minutes then was added 22.7 liters of a 40 g/liter gelatin solution at 82° C.

b) The vessel temperature was increased to 70° C. over 7 minutes. Then run 2.76N $AgNO_3$ solution to the vessel at 0.087 liters/min to adjust excess $Br^-$ concentration to 0.0123N. Then 10 liters of 2.76N $AgNO_3$ solution was added over 40.5 minutes with a parabolic flow profile. During this 40.5 minutes, there was maintained excess Br concentration at 0.0123N with 2.1N NaBr under feedback control. Dump in 2.1 liters of 4.75N NaBr. After 2 minutes, there was added 1.23 moles AgI as a Lippman emulsion. After 2 minutes there was run 2.76N $AgNO_3$ solution at 0.257 liters/-min. to the vessel until excess Br concentration is 0.0255N. $AgNO_3$ solution flow rate was reduced to 0.128 liters/min. and run until vessel excess Br concentration was 0.00422N. Grain size and standard deviation is reported in Table 1.

EXAMPLE 2 a) Start with an agitated vessel containing 36 liters solution of 27 g/liter gelatin and 0.0214N NaBr at 65° C. A device as in FIG. 1 was utilized with an inside diameter of the larger pipe 14 as 0.5 inch and the smaller pipe 16 of 0.1 inch inside diameter. A solution of 4.4 g/liter gelatin, 0.0893N NaBr at 35° C. at 10 L/min. was run through the larger pipe 14 to the vessel. After 3 seconds a 0.21N $AgNO_3$ water solution was run to the smaller pipe at 1 liter/min for 20 seconds. After 7 more seconds gelatin/salt solution flow was stopped. The process was continued as in b) in Example 1. Grain size and standard deviation is reported in Table 1.

EXAMPLE 3 (CONTROL)

a) Into an agitated vessel containing 5 liters solution of 1 g/liter gelatin and 0.067N NaBr at 50° C. was run 0.12N $AgNO_3$ solution in the close vicinity of the mixer at 0.15 liters/min. for 2 minutes. Immediately following this nucleation step, 7.5 liters of a 32 g/liter gelatin, 0.0224N NaBr solution at 70° C. was added.

b) The vessel temperature was then increased to 70° C. over 5 minutes, then held at 70° C. for 10 minutes. Then 2.6 liters of 2.75N $AgNO_3$ solution was added over 40 minutes with a linear flow profile from 0.016 to 0.114 liters/min. Grain size and standard deviation is reported in Table 1.

Examples 4 and 5 below use the invention process shown in FIGS. 5 and 6 with a sidearm recirculating loop added to the kettle. The nucleation step is accomplished by the addition of silver nitrate solution to the sidearm loop in an opposed tee fashion. The sidearm flow rate is 32 liters/min., the diameter at the silver addition point 0.5 inches for an approximate Reynolds number of 50,000. This design produces a very turbulent reaction zone that still has plug-flow behavior. Note that with the addition of the silver solution to the center of the stream, the slower fluid velocities at the pipewalls have less effect on the nucleating reaction. In this embodiment of the invention, the nucleation time, that is, the time during which silver solution is delivered to the sidearm reaction point, must be shorter than the loop's shortest possible recirculation time, in this case, 6 seconds, in order that the forming nuclei in the reaction stream are not exposed to already formed particles.

EXAMPLE 4 a) The vessel and sidearm loop contained a total of 5 liters of solution of 1 g/liter gelatin and 0.067N NaBr at 50° C. The sidearm loop was recirculating at 32 liters/-min. A 2.5N $AgNO_3$ solution was added to the sidearm addition point for 5 seconds at 0.26 liters/min. Immediately following this nucleation step, 7.5 liters of a 32 g/liter gelatin, 0.0224N NaBr solution at 70° C. was added. The process was continued as in b) in Example 3. Grain size and standard deviation is reported in Table 1 below.

EXAMPLE 5 a) The vessel and sidearm loop contained a total of 5 liters of solution of 1 g/liter gelatin and 0.1007 N NaBr at 50° C. The sidearm loop was recirculating at 32 liters/min. A 2.5N $AgNO_3$ solution was added to the sidearm addition point for 5 seconds at 0.26 liters/min. Immediately following this nucleation step, 7.5 liters of a 32 g/liter gelatin solution at 70° C. was added. The process was continued as in b) in Example 3. Grain size and standard deviation is reported in Table 1.

TABLE 1

| | Plug-Flow Nucleation Patent | |
|---|---|---|
| Example | Grain Size (Equivalent Circular Diameter in μm) | Coefficient of Variation (based on diameter) |
| 1 (control) | 1.1 | 19% |
| 2 | 1.4 | 15% |
| 3 (control) | 1.7 | 26% |
| 4 | 1.8 | 18% |

TABLE 1-continued

| | Plug-Flow Nucleation Patent | |
|---|---|---|
| Example | Grain Size (Equivalent Circular Diameter in μm) | Coefficient of Variation (based on diameter) |
| 5 | 2.3 | 14% |

As illustrated by Table 1 above, the coefficient of variation of emulsion 2 is significantly lower than that of emulsion 1, and those of 4 and 5 lower than 3, indicating improved monodispersity. As the only difference in formation was the invention nucleating step it is clear that the nucleating step provides a more uniform photographic grain by providing a more uniform starting grain to the ripening and growth processes.

The invention has been described in detail with particular reference to preferred embodiments thereof, but it will be understood that variations and modifications can be effected within the spirit and scope of the invention.

We claim:

1. A method of silver halide crystal nucleation comprising providing a solution comprising silver ions, providing a solution comprising halide ions, wherein peptizer may be present in at least one of the solutions, bringing said solutions together to form a nucleating mixture, conveying said mixture with plug flow during the nucleating period such that the nucleated silver halide crystals each have substantially identical particle time histories, such that the geometric standard deviation of the residence time distribution of the silver halide crystals during said nucleating is less than 1.30, and wherein said nucleating mixture is not exposed to previously nucleated grains during said nucleation.

2. The method of claim 1 wherein said standard deviation is less than 1.25.

3. The method of claim 1 wherein said conveying is with a Reynolds Number greater than 5,000.

4. The method of claim 3 wherein said Reynolds number is greater than 10,000.

5. The method of claim 1 wherein said nucleating period comprises between about 1 and about 30 seconds.

6. The method of claim 5 wherein said nucleating period comprises between 5 and 15 seconds.

7. The method of claim 1 wherein said peptizer is present in at least one solution and comprises gelatin.

8. The method of claim 1 wherein said peptizer is present in said solution comprising halide ions.

9. The method of claim 1 wherein peptizer is present in said solution comprising silver ions.

10. The method of claim 1 wherein said solution comprising halide ions and said solution comprising silver ions are both free of peptizer.

11. The method claim 1 wherein immediately after said bringing together the combined solutions are combined with a peptizer solution.

12. The method of claim 8 wherein said solution comprising halide ions and peptizer is withdrawn from a large container used for growth of said nucleated crystals.

13. The method of claim 12 wherein nucleation time is less than the time required for recirculation of material from the container to nucleation and back to said container.

* * * * *